United States Patent [19]

Baselice

[11] 4,032,077

[45] June 28, 1977

[54] COLLAPSIBLE SPINDLE ASSEMBLY FOR TOILET TISSUE ROLLS AND THE LIKE

[76] Inventor: Daniel S. Baselice, 639 Redman Ave., Haddonfield, N.J. 08033

[22] Filed: Aug. 20, 1976

[21] Appl. No.: 716,083

[52] U.S. Cl. ..... 242/55.2; 242/68.4

[51] Int. Cl.[2] ..... B65H 19/00

[58] Field of Search ..... 242/55.2, 55.3, 55.53, 242/68.3, 68.4, 129.51; 248/DIG. 5, 216; 403/2, 26, 249, 253, 255, 263

[56] References Cited

UNITED STATES PATENTS

| | | | |
|---|---|---|---|
| 3,156,425 | 11/1964 | Mynchenberg | 242/55.53 |
| 3,438,589 | 4/1969 | Jespersen | 242/55.2 |

*Primary Examiner*—Leonard D. Christian

*Attorney, Agent, or Firm*—Ostrolenk Faber Gerb & Soffen

[57] ABSTRACT

Mounting assemblies for toilet tissue rolls and the like comprised of tapered annular-shaped rims force-fittingly received within the hollow cylindrical core of a toilet tissue roll. A centrally located trunion portion is joined to the aforesaid rim by radially aligned spanning ribs having a width, thickness, geometry, and being of a plastic material which characteristics cooperate to provide flexibility of the mounting assembly to enable it to collapse into the core interior and, due to the "plastic memory" of the support ribs, cause the assembly to resume its normal expanded state upon the removal of the forces responsible for collapsing thereof, the trunions being adapted to be substantially telescopingly received within cooperating opening provided in a conventional receptacle, a pair of such assemblies cooperatively providing a "disposable spindle".

8 Claims, 3 Drawing Figures

COLLAPSIBLE SPINDLE ASSEMBLY FOR TOILET TISSUE ROLLS AND THE LIKE

BACKGROUND OF THE INVENTION

The most widespread assembly presently in use for mounting toilet tissue rolls typically is comprised of a stationary fixture or bracket permanently affixed to a wall or other support, said receptacle having a pair of outwardly-projecting usually parallel arms each provided with an opening, said openings being axially aligned. The tissue roll is typically comprised of a cylindrical paper or cardboard core, having the tissue wrapped therearound in a spiral fashion. A spindle member typically comprised of a pair of elongated hollow cylindrical members, one of which is telescopingly received within the other member. A spring or other suitable biasing means is usually mounted within the hollow interior of the spindle to bias the telescoping members so that they are urged to move apart from one another, the spring member having sufficient resilience to permit contraction or collapsing of the two elements. The free ends of the cylindrical elements have tips whose reduced diameters adapt them for entry into an associated one of the aforesaid openings provided in the toilet tissue receptacle. Shoulders are usually provided inwardly from the tips so as to limit the amount of entry of the tips into the aforesaid receptacle openings.

Mounting of a bathroom tissue roll is typically accomplished in the following manner:

The bathroom tissue roll is usually wrapped within a paper cover, which is removed. The spindle is removed from the receptacle, which now contains an exhausted roll, or which is otherwise empty. The spindle is inserted through the hollow interior of the core of the new toilet tissue roll and the roll is positioned for entry into the receptacle and between the aforesaid arms. The roll and the spindle are aligned in the region between the receptacle arms in a skewed manner to cause one tip of the spindle to be entered into the opening of the associated receptacle arms. Thereafter, the opposite tip of the spindle is typically pressed towards the said one tip by the operator's fingers, causing the cylindrical element to collapse in a telescoping fashion and for the purpose of reducing the overall length of the spindle in order that it might be pressed in between the aforesaid arms of the receptacle.

The latter tip is then released after being positioned immediately over the opening in the remaining arm, at which time the resilience of the biasing member urges the cylindrical members apart to snappingly urge the spindle into the operative position. The outer diameter of the spindle is typically significantly smaller than the inner diameter of the hollow core, allowing the roll to be freely rotated about the spindle in order to facilitate the dispensing of the toilet tissue.

Although not explained above in detail, the steps described herein are substantially reversed for the purpose of removing the toilet tissue core once the paper roll is exhausted.

As can be seen from the above description, the assembly requires a spindle of a particular design. It further requires removal and insertion thereof from the exhausted and new rolls respectively, in order to properly mount the fresh paper roll.

Another type of mounting which eliminates the need for a spindle is typically comprised of a mounting bracket in which one or both of the arms mentioned hereinabove are biased inwardly towards one another, and the manner of mounting a new roll is comprised of the steps of forcing the arms apart a distance sufficient to enter the roll therebetween, aligning the both ends of the hollow core with a fresh paper roll between the ends of the arms, each of which are provided with inwardly-directed projections, and then releasing the arms in order to hold the toilet tissue roll. One of the disadvantages of this arrangement resides in the fact that the inwardly-directed projections provided at the ends of the arms are usually of diameters necessitating their use with tissue rolls having hollow cores of the appropriate diameter, it being noted that hollow cores of various manufacturers do not have the same diameter, but in fact vary in their internal diameters. In addition, the biasing force usually urges the arms into engagement with the sides of the roll, making it difficult to rotate the roll about the projections for the purpose of dispensing paper.

BRIEF DESCRIPTION OF THE INVENTION

The present invention is characterized by providing a novel assembly which functions as a complete and inexpensive substitute for the conventional spindle, to totally eliminate the need for the spindle and dismounting and mounting operations associated therewith.

The present invention is comprised of a lightweight, thin one-piece plastic member having an annular-shaped rim portion and an internally truncated conical-shaped trunion portion, which portions are joined to one another by a plurality of intermediate spanning ribs such that the plastic material from which the ribs are formed together with the thickness and geometry of the ribs serve to make the one-piece plastic member totally collapsible and yet provide the ribs with a "plastic memory" which enables the one-piece assembly to resume its normal uncollapsed condition upon the removal of the collapsing forces.

A pair of the aforesaid one-piece members are force-fittingly received within an associated end of a toilet tissue hollow core. The flexibility of the ribs enables the mounting element to collapse so as to be totally received within the associated hollow core opening so that the toilet tissue roll may be packaged in the conventional manner and the package will be of no greater outer dimensions as a result of insertion of the mounting members.

The one-piece members of the present invention are of a design which greatly facilitates its manufacture. For example, the design lends itself nicely to the manufacture of the one-piece members for example, either through a vacuum forming or an injection molding operation.

OBJECTS OF THE INVENTION AND BRIEF DESCRIPTION OF THE FIGURES

It is, therefore, one object of the present invention to provide a pair of novel lightweight disposable one-piece members and a receptacle therefore which are adapted to cooperate with conventional toilet tissue rolls to facilitate their mounting in order to rollably mount the bathroom tissue facilitating dispensing thereof.

Another object of the present invention is to provide a pair of novel one-piece mounting members of a disposable type and usable with conventional toilet tissue rolls and receptacles therefore, said members being received within the hollow core of the roll and being totally collapsible into the interior of the core to facilitate packaging of the mounting members together with the roll, without in any way changing the nature or size of the conventional packages, while at the same time eliminating the need for conventional spindles while providing the functions normally provided by conventional spindles.

Still another object of the present invention is to provide a novel one-piece member of the character described in the above mentioned objects wherein said member is formed of a suitable plastic material having a plastic memory and being of a thickness to enable collapsing of the element under a substantially light compressive force while the plastic memory is adapted to enable the mounting members to assume their uncollapsed state upon removal or release of the collapsing forces.

The above as well as other objects of the present invention will become apparent when reading the accompanying description and drawings, in which:

FIG. 1*a* shows a top plan view of a bathroom tissue roll mounting member designed in accordance with the principles of the present invention.

FIG. 1*b* shows a elevational view, partially sectionalized, of the member of FIG. 1*a*.

FIG. 2 shows a sectional view of the manner in which the members are mounted within the hollow core of a toilet tissue roll.

DETAILED DESCRIPTION OF THE FIGURES

Figure 1B:
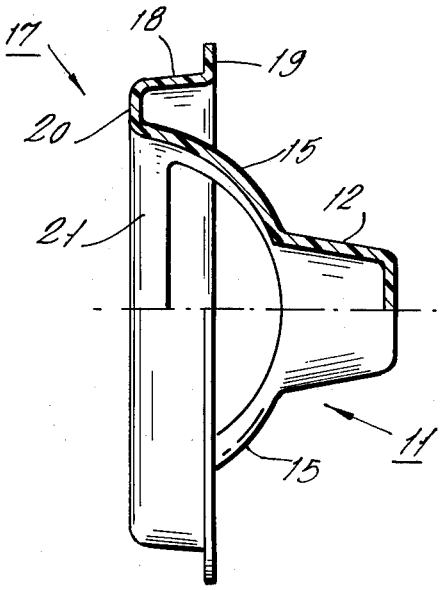
Figure 1A:
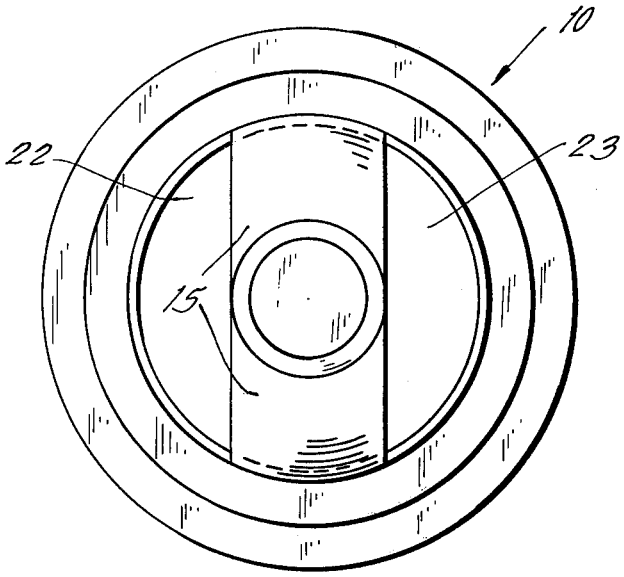

Referring initially to FIGS. 1*a* and 1*b*, there is shown therein a thin, lightweight, disposable one-piece mounting member designed in accordance with the principles of the present invention, and provided for the purpose of facilitating the mounting of bathroom tissue rolls while totally eliminating the need for conventional spindle assemblies. Member 10 is comprised of a trunion portion 11 and a rim portion 17 cooperatively joined and associated with one another by means of intermediate ribs 15, which are integrally joined to the trunion 11 and rim 17, and which function to facilitate both collapsing and resumption of the normal uncollapsed state, as will be described hereinbelow.

The rim portion is provided with a truncated conical surface 18 having a slight taper and having at its right-hand free end a radially outwardly-directed flange which serves to limit the depth of insertion of member 10 within the core of a bathroom tissue roll, as will be more completely described herein below.

The opposite end of rim portion 18 is integrally joined with a circular-shaped flange 20 directed radially inward from rim 18.

The innermost portion of flange 20 is provided with a truncated spherical portion 21 integrally joined to the radially inward end of flange 20, and having portions thereof joined to the spanning ribs 15.

The trunion member 11 comprises a hollow truncated conical-shaped portion whose smaller diameter end terminates in a closed top portion 13 integrally joined to portion 12.

Figure 2:
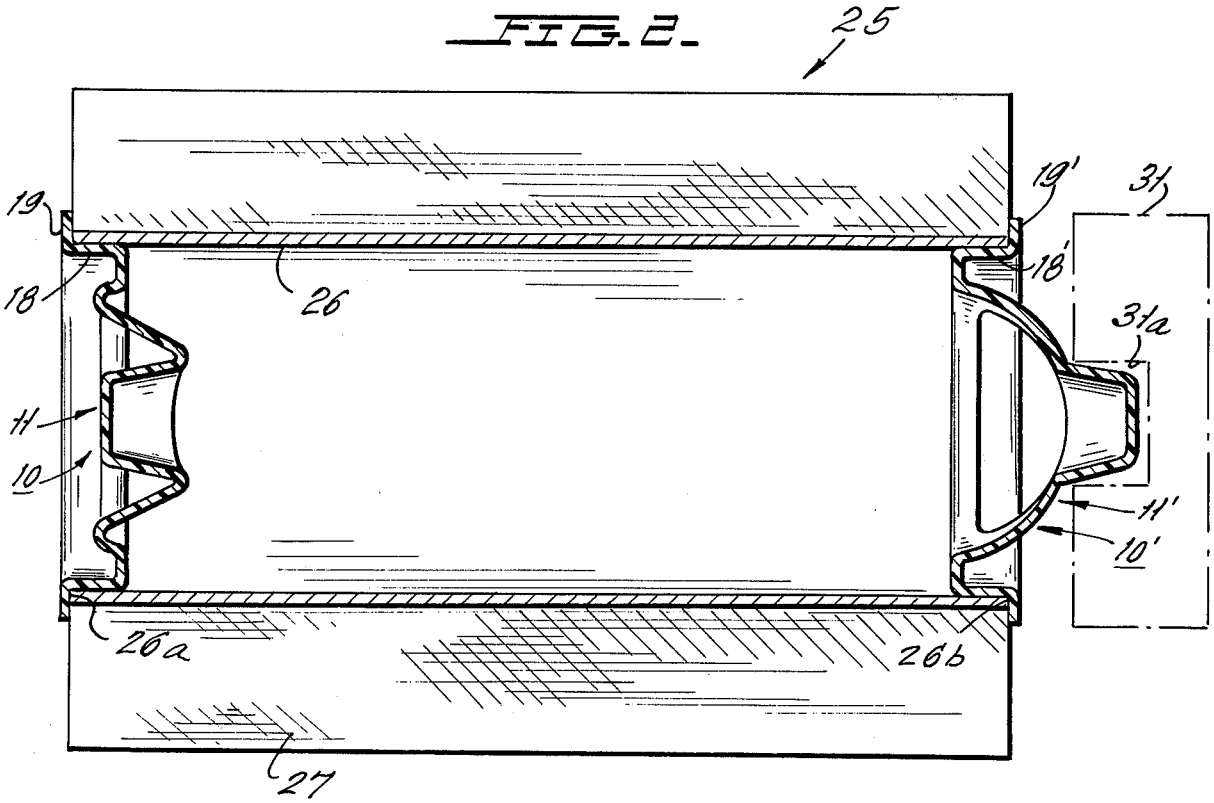

The larger diameter end has portions thereof integrally joined to the spanning ribs 15, as shown best in FIG. 1*b*. It should be understood that the trunion portion is hollow, as best shown in the sectionalized portion of FIG. 1*b*. The truncated hemispherical portion 21, together with spanning ribs 15 form the openings 22, 23, which are truncated, circular-shaped openings as shown best in the plan view of FIG. 1*a*. FIG. 2 shows the manner in which the bathroom tissue mounting members are utilized and comprises a bathroom tissue roll 25 comprised of a hollow cylindrical core 26 typically formed of a stiff paper or cardboard. The toilet tissue 27 is typically a soft paper roll of indeterminate length defining individual sheets by perforations provided at spaced parallel intervals along the roll, the paper roll being wound in spiral fashion, forming composite assembly 25.

A pair of mounting members 10 and 10' are inserted into the core such that the rims 18 and 18' force-fittingly engage the inner diameter of the core and are slightly compressed, causing the slight taper as shown in FIG. 1*b* to disappear, whereby the rims 18 and 18' are arranged parallel to the engaging surfaces of the hollow core 26. The slight taper of rim 18 enhances the force-fit between the rim and the core 26.

Due to the nature of the plastic material, and the thickness of the mounting members, as well as their geometry, the rib members are easily capable of collapsing to the extent shown by the left-hand mounting member 10 of FIG. 2 wherein the entire trunion portion is adapted to be positioned well within the left-hand end **26*a* of hollow core 26. As can clearly be seen from FIG. 2, the outwardly directed flanges 19 and 19' serve to limit the depth to which the mounting members 10, 10' may be inserted within the hollow core. The collapsing of the members, for example, as shown by the left-hand member 10 of FIG. 2, may be accomplished during normal packaging, wherein the present thin lightweight paper wrapper placed around such bathroom tissue rolls is more than sufficient to maintain the mounting units in the collapsed position, the portion which collapses actually bends, so as to collapse the trunion member toward the rim portion. The spanning ribs have a thickness, geometry, and are made of a plastic material such as, for example, polypropylene, which is adapted to enable the element to be readily collapsed upon packaging and, due to the "plastic memory" of the material, the spanning ribs will assume their natural unbent state, i.e. the mounting member 10 will assume its uncollapsed state, so as to cause the trunion portion 11 to project outwardly beyond the edge, for example the edge 26*b* of hollow core 26**.

The manner of mounting a toilet tissue roll utilizing the mounting members of the present invention is substantially similar to that technique employed in conventional methods, wherein the roll including the mounting members is oriented in skewed fashion relative to the toilet tissue roll receptacle arms so as to place one of the trunion members, for example, the trunion member 11' of FIG. 2 in the opening **31*a* provided in an arm 31** of a receptacle.

The other trunion member is pressed in lightly by one or more fingers, and the roll is then moved in to a substantially aligned position, preferably so that the center line 32 of the mounting members is coaxial with the center line of the receptacle openings. Upon reaching this position, the fingers are released from the collapsed trunion member and its "plastic memory" causes it to move outwardly from the position occupied by the left-hand mounting member 10 of FIG. 2 to the position of the right-hand member 10' of FIG. 2 and snap into the associated receptacle arm opening, whereby both trunion portions are mounted within appropriate openings, it being understood that an arm substantially identical to arm 31 is provided adjacent the left-hand side of roll 26 and is provided with a hole substantially identical to hole 31*a* for receiving trunion portion 11. Both elements 10 and 10' cooperatively function in the same manner as a conventional spindle, enabling the roll to be rotated about center line 32 in order to dispense the toilet tissue.

The simplicity of design of the mounting members is such as to readily lend themselves to high-speed mass production manufacturing, wherein the members may be produced through a vacuum forming or injection molding operation, for example.

The mounting members may be formed of any suitable plastic and in one preferred embodiment the mounting members are formed of polypropylene and have a substantially uniform thickness of the order of 0.03 inch.

Whereas the preferred embodiment of the present invention teaches the trunion as being integrally joined to the rim portion by means of a pair of spanning ribs aligned along one diameter of the mounting member, it should be understood that more than two ribs may be employed, and further that the ribs need not be diametrically aligned but can be aligned at equi-spaced angles. For example, if 3 such spanning ribs were employed, the ribs may be arranged at 120° intervals about the trunion portion. Obviously if 4 ribs are utilized, they may be arranged at equi-spaced 90° intervals, and so forth. Also, the trunion portion need not have a closed end 13.

It can be seen from the above description that the present invention provides a novel lightweight, thin, inexpensive, and hence, disposable type of mounting means for toilet tissue and the like, wherein the need for a conventional spindle is eliminated and the substitute therefore is of nominal expense at most. The utilization of the mounting means of the present invention is, in fact, even safer and easier to use than conventional spindles especially by children, since the mounting means come already inserted into the toilet tissue roll, whereas conventional spindles must first be removed from the exhausted roll and inserted into the new roll before mounting thereof. Removal of exhausted rolls requires no particular care since the core and mounting members being removed are discarded.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Mounting means for toilet tissue rolls and the like, said rolls being typically comprised of a hollow cylindrical-shaped core having an elongated toilet tissue sheet of indeterminate length wound therearound, said mounting means being a pair of members each comprised of:

a single thin light-weight one-piece member comprised of a rim portion and a trunion portion;

said rim portion having an outwardly-directed flange integrally joined at one end thereof and having an inwardly-directed continuous flange integrally joined at the opposite end thereof;

said trunion portion being comprised of a hollow truncated conical-shaped shell, the narrow end thereof being remote from said rim portion, and the wider end thereof being closer to said rim portion;

at least first and second spanning ribs, each of said ribs having a first end integrally joined to said inwardly directed flange having opposite ends integrally joined to the wider end of said trunion portion;

said one-piece member being made of a suitable resilient plastic material, the thickness of said spanning ribs being selected so as to enable the spanning ribs to bend in other to permit the trunion portion to collapse towards said rim portion and being further adapted due to the inherent resilience of the material to enable, by virtue of the plastic memory of the material, to assume its natural condition, whereby the trunion portion is moved away from the rim portion as the spanning ribs assume their natural unbent condition.

2. The apparatus of claim 1 wherein said mounting members are force-fittingly inserted into each open end of said hollow core whereby said outwardly directed flange serves to limit the depth of insertion of said mounting means into said hollow core.

3. The apparatus of claim 2, wherein said rim has a slight taper so that its edge integrally joined to the outwardly directed flange is of a slightly greater diameter than its edge integrally joined to the inwardly-directed flange to thereby enhance the force-fitting arrangement between said rim and said hollow core.

4. The apparatus of claim 1, wherein the mounting means are preferably formed from a polypropylene material through a vacuum forming operation.

5. The apparatus of claim 1, wherein the mounting means is formed of a polypropylene material through an injection molding operation.

6. The apparatus of claim 2, wherein the thickness of said mounting means is of the order of 0.030±0.10 inches.

7. The apparatus of claim 1, wherein the narrow diameter end of said trunion portion is provided with a flat surface portion integrally joined to said narrow diameter and whereby said hollow truncated conical portion and said end surface form a closed trunion tip portion.

8. The apparatus of claim 1, wherein the thickness and plastic material are selected so as to enable bending of the spanning ribs to totally collapse the trunion portion into the internal portion of the hollow core to facilitate storage thereof when the paper roll is packaged within a cover sheet.

* * * * *